US005088465A

United States Patent [19]

DeBiasi et al.

[11] Patent Number: 5,088,465

[45] Date of Patent: Feb. 18, 1992

[54] FAST START FUELING FOR FUEL INJECTED SPARK IGNITION ENGINE

[75] Inventors: Charles J. DeBiasi, Allen Park; Viren B. Merchant, Canton; James B. Maurer, Farmington Hills; Larry A. Hardy, Riverview, all of Mich.

[73] Assignee: Ford Motor Company, Dearborn, Mich.

[21] Appl. No.: 705,676

[22] Filed: May 24, 1991

[51] Int. Cl.[5] ..... F02D 41/06; F02P 5/145

[52] U.S. Cl. ..... 123/491; 123/424; 123/179.17

[58] Field of Search ..... 123/179 G, 414, 415, 123/416, 417, 424, 476, 478, 491

[56] References Cited

U.S. PATENT DOCUMENTS

| | | | |
|---|---|---|---|
| 4,131,098 | 12/1978 | Daniels et al. | 123/415 |
| 4,418,674 | 12/1983 | Hasegawa et al. | 123/179 L X |
| 4,489,691 | 12/1984 | Ono et al. | 123/424 |
| 4,515,131 | 5/1985 | Suzuki et al. | 123/491 |
| 4,553,426 | 11/1985 | Capurka | 123/414 X |
| 4,656,993 | 4/1987 | Yuzawa et al. | 123/643 |
| 4,732,122 | 3/1988 | Scarnera et al. | 123/491 X |
| 4,797,827 | 1/1989 | Cockerham | 123/414 X |
| 4,867,115 | 9/1989 | Henein | 123/179 L |
| 4,875,443 | 10/1989 | Sano et al. | 123/491 X |
| 4,941,449 | 7/1990 | Höptner et al. | 123/491 X |
| 5,027,779 | 7/1991 | Nishiyama | 123/491 |
| 5,038,740 | 8/1991 | Tachibana et al. | 123/491 |

*Primary Examiner*—Willis R. Wolfe

*Attorney, Agent, or Firm*—Peter Abolins; Roger L. May

[57] ABSTRACT

This invention includes a method and apparatus for starting an internal combustion engine with a reduced starting time. That is, there is a reduced delay before the first combustion event occurs in the engine. Only a single engine position sensor is used. The method includes injecting fuel into a cylinder before true engine position is determined and applying an ignition pulse to the cylinder and firing the ignition coil after fuel has been injected into the cylinder. Advantageously, injecting fuel for the cylinder is done after determining the engine is turning and determining the engine has a rotational rate below a predetermined parameter.

12 Claims, 5 Drawing Sheets

SYNCHRONIZATION FOR BASE ALGORITHM (PRIOR ART)
VRS CRANKSHAFT POSITION SIGNAL

PIP SYNCHRONOUS TO ENGINE POSITION
PIP

FUEL SYNCHRONOUS TO ENGINE POSITION
INJECTORS

COMBUSTION OCCURS HERE
WASTED SPARK W
WASTED SPARK W
COIL FIRE
t + Δt
1ST COMBUSTION "C"

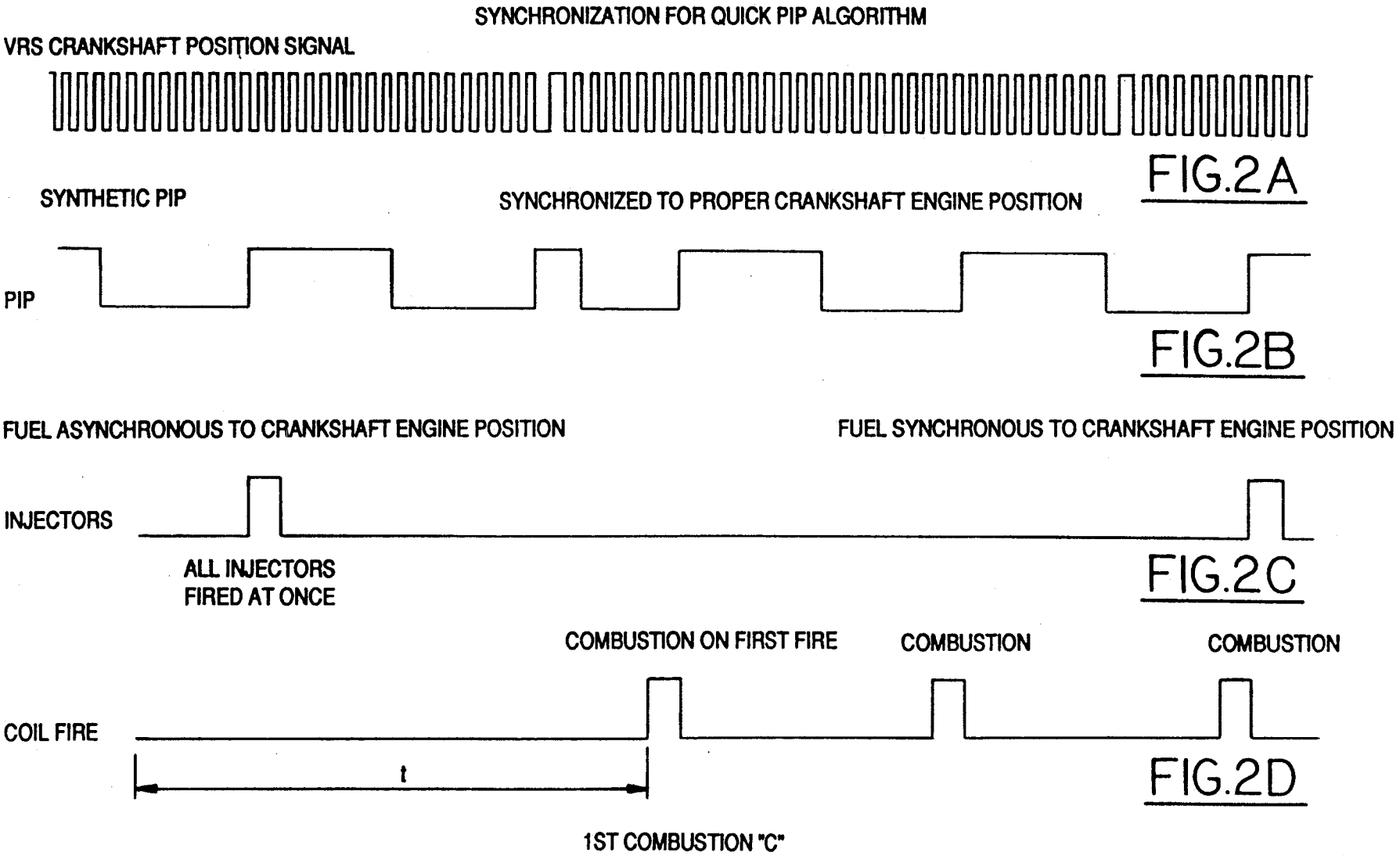
SYNCHRONIZATION FOR QUICK PIP ALGORITHM
VRS CRANKSHAFT POSITION SIGNAL
FIG.2A
SYNCHRONIZED TO PROPER CRANKSHAFT ENGINE POSITION
SYNTHETIC PIP
PIP
FIG.2B
FUEL SYNCHRONOUS TO CRANKSHAFT ENGINE POSITION
FUEL ASYNCHRONOUS TO CRANKSHAFT ENGINE POSITION
INJECTORS
ALL INJECTORS FIRED AT ONCE
FIG.2C
COMBUSTION
COMBUSTION
COMBUSTION ON FIRST FIRE
COIL FIRE
t
1ST COMBUSTION "C"
FIG.2D

BASE ALGORITHM (PRIOR ART)

NEW ALGORITHM

FAST START FUELING FOR FUEL INJECTED SPARK IGNITION ENGINE

BACKGROUND OF THE INVENTION

1. Field of the Invention

This invention relates to electronic engine control of an internal combustion engine.

2. Prior Art

The primary function of an Enhanced Distributorless Ignition System (EDIS) is to deliver a full energy spark at a crank angle calculated by an Electronic Engine Controller (EEC). The EDIS module determines the engine position using a high data rate crankshaft position sensor such as a variable reluctance sensor (VRS). The EDIS module generates a profile ignition pickup (PIP) signal from the high data rate VRS crankshaft position signal. The EEC uses this PIP signal to determine fuel scheduling, engine RPM and engine position.

The EDIS module synchronizes to the signal produced by the VRS sensor. The signal produced by the VRS sensor is proportional to a crankshaft mounted 36 tooth wheel. One of the teeth in this wheel is selectively removed to coincide with cylinder number one pair and is termed a missing tooth. Cylinder number one pair indicates the position of the crankshaft at either cylinder number one and its opposite cylinder having a common ignition coil.

Using a base algorithm during initial synchronization, the EDIS module requires three VRS teeth, following the missing tooth in order to synchronize to engine position. A plot of the signals representing VRS, PIP, fuel injector firing and ignition coil firing signal during synchronization is shown in FIGS. 1A, 1B, 1C, and 1D, respectively. The time required for synchronization depends on engine stall position. With noise coupled to the VRS signal it becomes harder to differentiate true engine rotation from noise. A software VRS filter algorithm is used to determine the true VRS signal.

In the base algorithm the EDIS module synchronizes to the missing tooth and puts out the PIP signal to the EEC. The EEC will then inject fuel into the cylinder after a valid PIP signal edge is received. The fuel must go through an intake and compression stroke before the air/fuel mixture is ready to ignite. This causes the first spark to be wasted since there was no air/fuel mixture to be ignited in the cylinder receiving the spark. The result of using such a base algorithm is longer and inconsistent start times.

Also known is U.S. Pat. No. 4,131,098 which teaches a hardware ignition system to generate a spark event at the earliest top dead center engine position. This patent does not teach delaying the spark event until an air/fuel mixture is available to be ignited in a cylinder. Further, this patent does not teach a system adaptable to a distributorless ignition system.

U.S. Pat. No. 4,656,993 teaches a system for identifying the position of specific engine cylinders. The patent does not teach improving start times.

U.S. Pat. No. 4,515,131 teaches reducing engine start times by providing engine combustion at the earliest possible event, within one crankshaft revolution by using both a crankshaft angle sensor and a cylinder discrimination signal. It would be desirable to need only a crankshaft angle sensor and not have a need for a cylinder discrimination signal. There is taught a method and apparatus for igniting an air/fuel mixture within one rotation of the engine crankshaft by injecting fuel on the first crankshaft angle signal after the start of cranking. In FIG. 3 of patent '131 at indication (2) is a crank angle signal N, and at indication (3) is a cylinder discrimination signal G, indicating true engine position. At indications (4)-(9) are timing charts for cylinders 1-6 showing intake in ignition for each cylinder. Indications (10)-(12) show the system when engine cranking, as determined from a starter signal, occurs at various times in the engine cycle with reference to indications (4)-(9) above. As to indications (10)-(12), all have in common injecting fuel FU in accordance with the first crank angle signal after the start of cranking CR, thereby achieving a faster engine starting time. This can be contrasted with another prior art system shown in FIG. 4 of patent '131 in which fuel injection FU occurs after cylinder discrimination signal G (2) with cranking CR occurring between G (1) and G (2).

Thus, the system of patent '131 as shown in FIG. 3 requires the cylinder discrimination signal G as well as the crank angle signal to schedule fuel. It would be desirable to have an algorithm that would not require a cylinder identification signal to schedule fuel injection time. Indeed, it would be desirable to avoid the time delay caused by first locating true engine position before injecting fuel. These are some of the problems this invention overcomes.

SUMMARY OF THE INVENTION

To obtain advantageously shorter and more consistent start times, a fast start fueling algorithm is used by the EDIS module to generate a PIP, initially called a synthetic PIP, before the location of the missing tooth is found. This allows the EEC module to inject fuel into the cylinder as soon as the engine begins to rotate and before the true engine position is determined. A plot of VRS, PIP, injector firing and coil firing is shown in FIG. 2. The flowchart showing the new algorithm is shown in FIG. 5. The criteria under which this synthetic PIP is generated include that the engine is turning at a relatively low speed RPM, and that the engine rotation has not exceeded two revolutions without synchronizing to the missing tooth.

The algorithm allows the EEC to continue to monitor the relative engine position since the start of the crank although true engine position is unknown. One asynchronous fuel pulse is generated from each cylinder event. Once the true engine position is located the fuel pulses are synchronized to the true engine position and the EDIS module starts the ignition sequence. This allows the mixture to ignite on the first since fuel already exists in the cylinder.

To determine the effectiveness of an embodiment of this invention, start times were measured with the base algorithm and the fast start algorithm on the same vehicle. The following table shows the actual start times in seconds:

| Fast Start Algorithm | Base Algorithm |
|---|---|
| 0.69 | 0.85 |
| 0.66 | 1.08 |
| 0.64 | 0.83 |
| 0.68 | 0.91 |
| 0.71 | 0.87 |
| 0.67 | 1.07 |
| 0.65 | 0.88 |
| 0.67 | 0.90 |
| 0.62 | 0.98 |
| 0.65 | 1.12 |

-continued

| | Fast Start Algorithm | Base Algorithm |
|---|---|---|
| Average | 0.66 | 0.95 |
| Std. deviation | 0.025 | 0.10 |

The start times with the fast start algorithm are about 30° better then the base algorithm with the standard deviation reduced by a factor of four. Also note that the starts are more consistent, showing a very small standard deviation. The distribution curves for the above data are shown in FIGS. 3 and 4 for the base algorithm and the fast start algorithm, respectively.

Advantages in accordance with an embodiment of this invention include utilization of only a single crankshaft position sensor and a missing tooth timing wheel for crankshaft angular position referencing; early fuel injection based on engine speed, which does not require identification of engine angular position; reduction in start time variabilities; and inferred engine start conditions, without requiring a start signal, for inferred early fueling.

BRIEF DESCRIPTION OF THE DRAWINGS

FIGS. 2A-2D are graphical representations to FIGS. 1A-1D, but in accordance with an embodiment of this invention, wherein FIG. 2A shows the output of a variable reluctance sensor, FIG. 2B shows the profile ignition pulse, FIG. 2C shows injector actuation, and FIG. 2D shows ignition coil firing;

DETAILED DESCRIPTION OF THE INVENTION

Figures 1A, 1B, 1C, 1D:
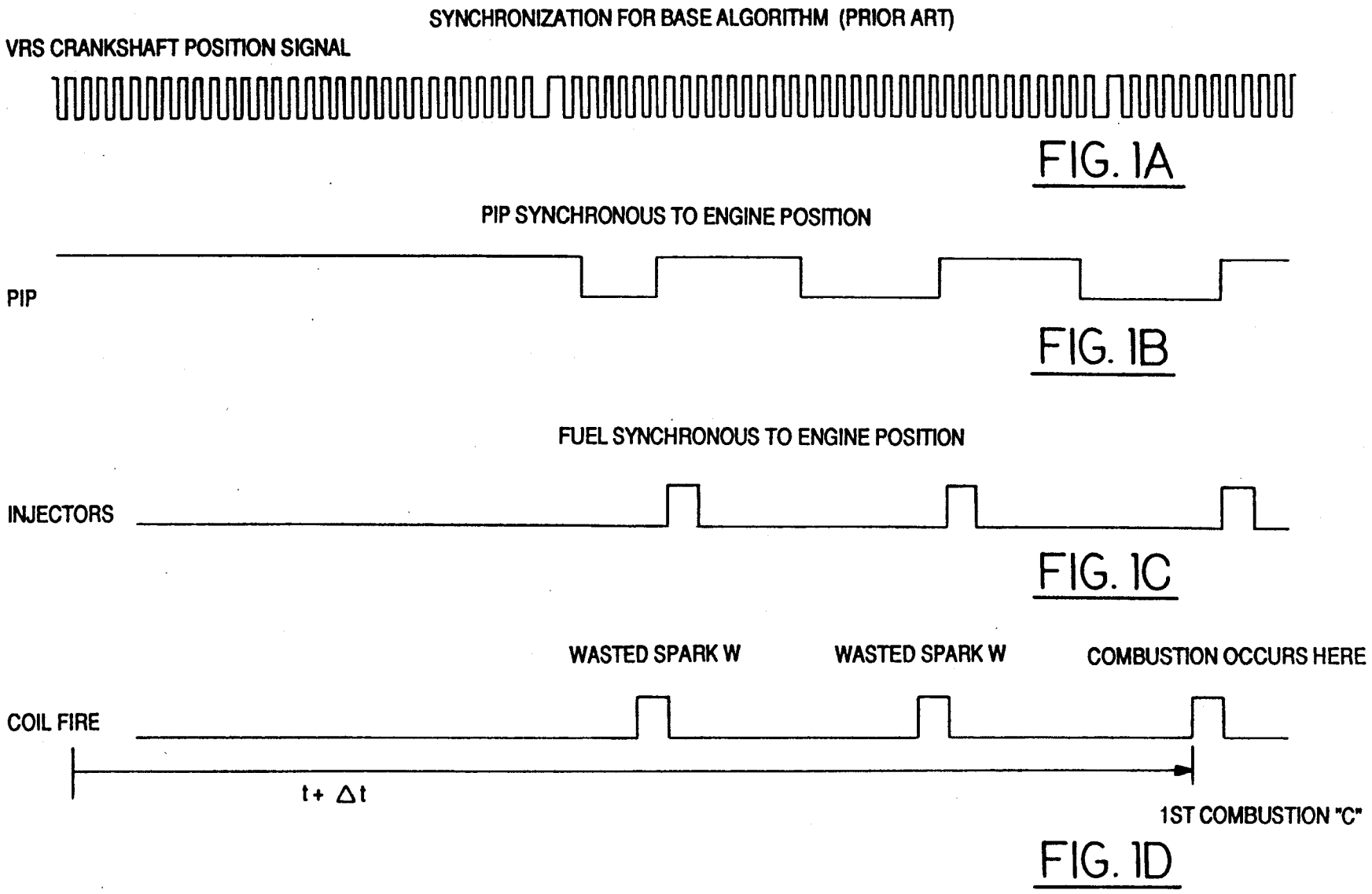
FIGS. 1A-1D are prior art graphical representations of time graphs of the output of a variable reluctance sensor in FIG. 1A, profile ignition pulse in FIG. 1B, injector actuation in FIG. 1C and ignition coil firing in FIG. 1D.

Referring to FIG. 1, synchronization for a prior art base algorithm of engine control required locating the missing tooth and the VRS signal of FIG. 1A and then initiating an ignition pulse as indicated in FIG. 1B which in turn causes ignition coil firing as indicated on FIG. 1D and then subsequent fuel injector actuation and injection of fuel as indicated in FIG. 1C.

Referring to FIG. 2, in accordance with an embodiment of this invention, FIG. 2A has VRS signals immediately causing a PIP signal, initially called a synthetic PIP for fast start, in FIG. 2B which then cause fuel injector actuation and fuel injection to take place as indicated in FIG. 2C and then a subsequent ignition coil firing as indicated in FIG. 2D. Note that in FIG. 2 in accordance with an embodiment of this invention when the ignition coil firing occurs fuel has already been injected into the cylinder for combustion. Thus, engine starting can take place.

By comparing FIGS. 1 and 2 it can be seen that firing an ignition coil in accordance with an embodiment of this invention produces a combustion event, C, substantially sooner than a combustion event, C, occurs in accordance with the prior art base algorithm of FIG. 1. Because fuel has not been supplied in the prior art base algorithm several ignition firings occur without the presence of fuel and result in a waste spark, W.

Figure 3:
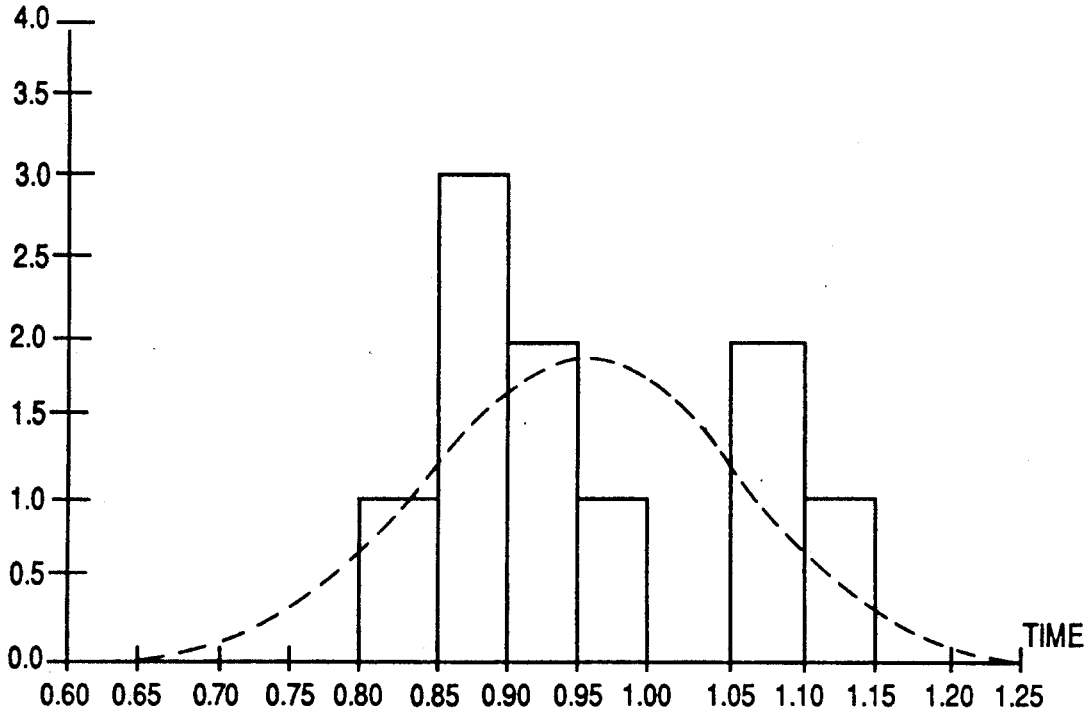
FIG. 3 shows a graphical representation of a distribution of the number of starts versus the time of starting in accordance with the prior art.
Figure 4:
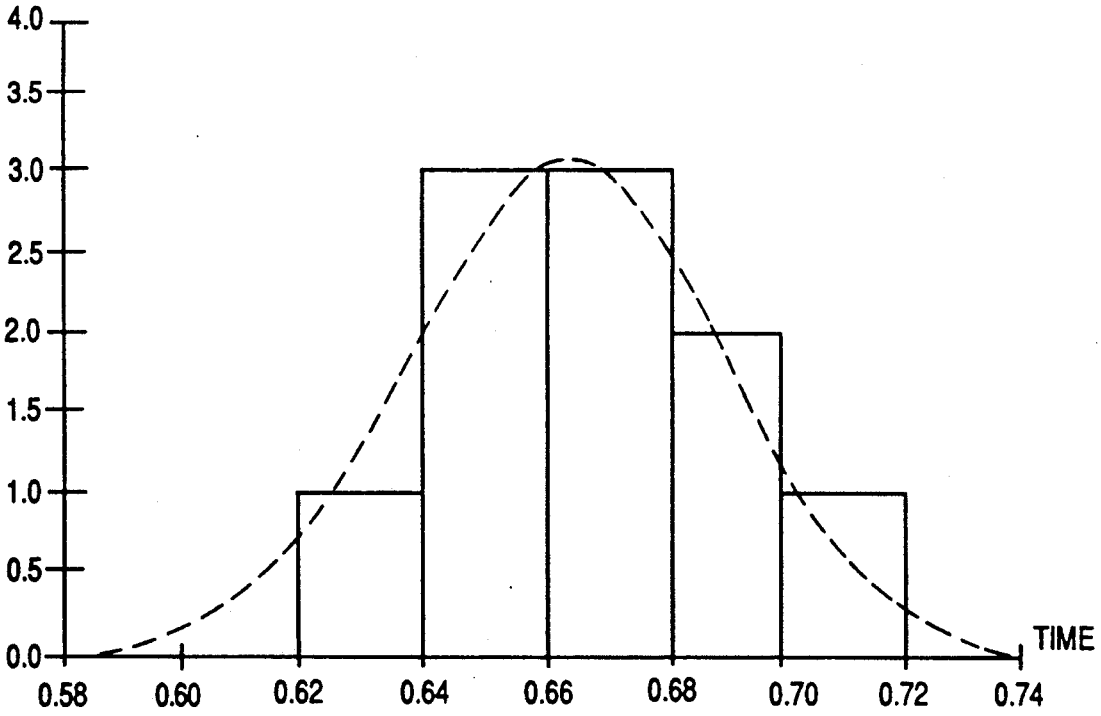
FIG. 4 is a graphical representation similar to FIG. 3 of the distribution of the number of starts versus the starting time in accordance with an embodiment of this invention.

FIG. 3 illustrates the starting time of the prior art and FIG. 4 illustrates the starting time in accordance with an embodiment of this invention. Note that comparing this invention to the prior art there is less variation and that the mean starting time is reduced from about 0.95 seconds to 0.66 seconds.

Figure 5:
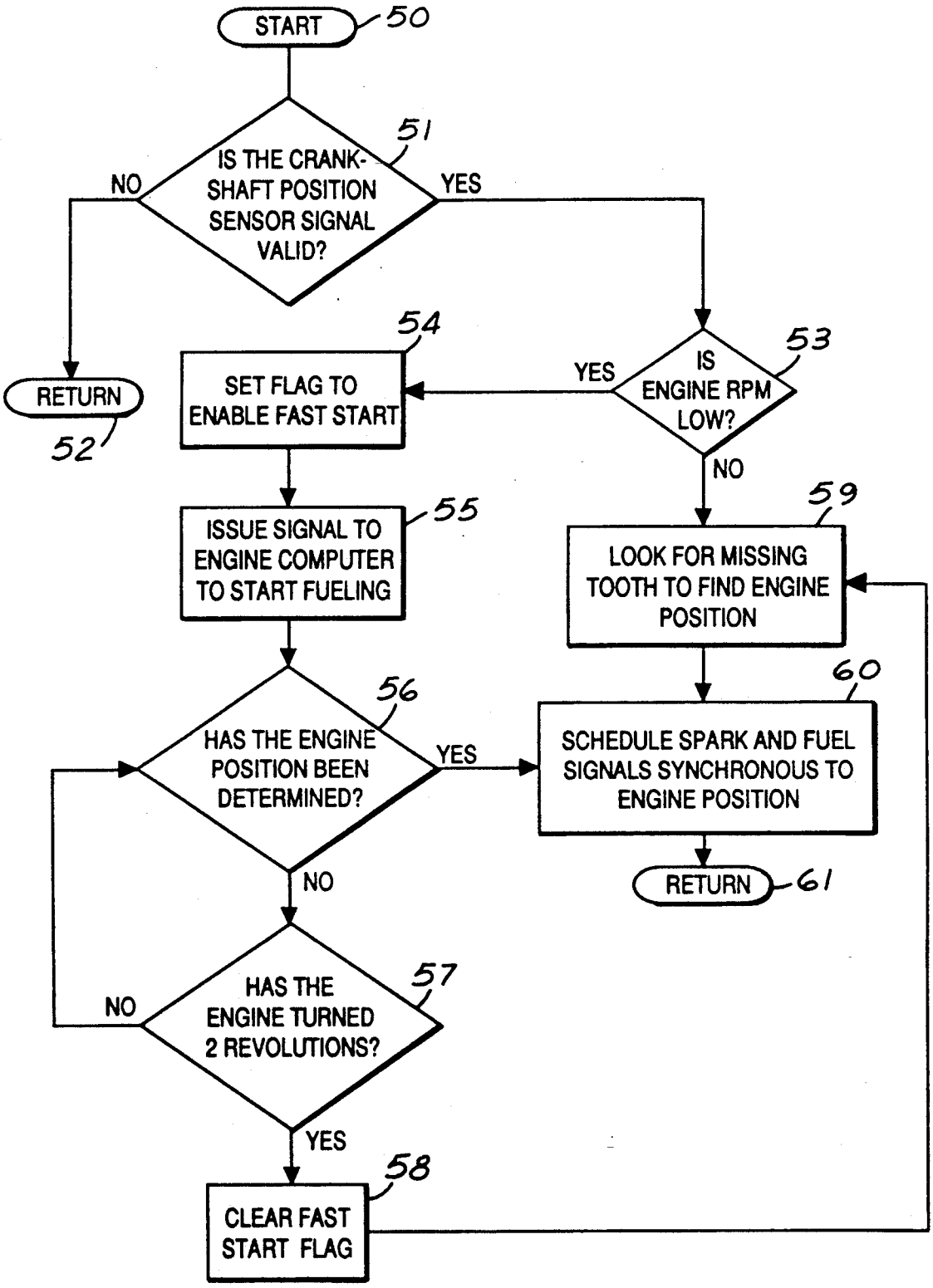
FIG. 5 is a logic flow diagram of a spark and fuel algorithm in accordance with an embodiment of this invention.

Referring to FIG. 5, logic flow starts at a block 50 and then goes to a decision block 51 wherein the question is asked whether the crankshaft position sensor signal is valid. If the answer is NO, logic flow goes to a return block 52. If the answer is YES, logic flow goes to a decision block 53 wherein it is asked if engine RPM is low. Advantageously, a predetermined parameter is used to determine an engine RPM which is used as a dividing line to determine whether the actual engine RPM is low or not. If the answer is YES, logic flow goes to a block 54 wherein a flag is set to start the fast start algorithm and logic flow continues to a block 55 where there is issued a signal to the engine computer to start fueling and to a decision block 56 where it is questioned if the engine position been determined.

If the engine position has not been determined at block 56, logic flow goes to a decision block 57 where it is questioned if the engine turned two revolutions. If it is determined that the engine has not turned two revolutions, logic flow goes back to decision block 56. On the other hand, if the engine has turned two revolutions, logic flow goes to a block 58 wherein a fast start flag is cleared. The output of block 58 and the output of decision block 53 for the answer NO,( i.e., is engine RPM low), both go to a block 59 where the action is to look for a missing tooth to find engine position. The output of block 59 goes to a block 60 wherein spark and fuel signals are scheduled synchronously to engine position. Logic flow also proceeds to block 60 from decision block 56 if the answer is YES to the question if the engine position has been determined. Logic flow from block 60 goes to a block 61 where logic flow returns to the start.

Figure 6:
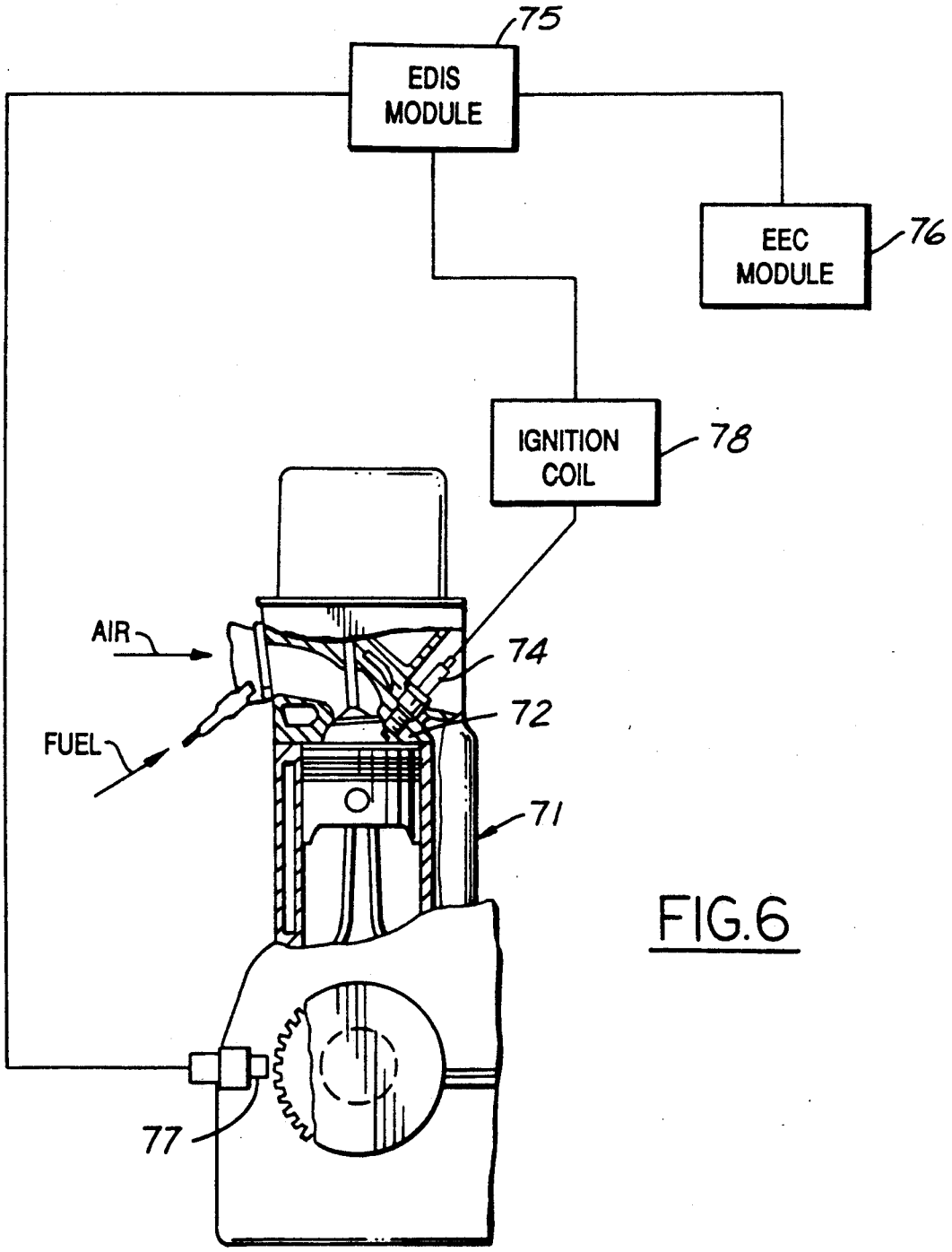
FIG. 6 is a block diagram of an engine and control system in accordance with an embodiment of this invention.

Referring to FIG. 6, an engine 71 includes a cylinder 72 having a fuel injector 73 coupled thereto and a spark plug 74. An ignition module 75 is coupled to the spark plug 74 through an ignition coil 78 and to an electronic engine control computer 76. A crankshaft position sensor 77 is coupled to engine 71. Engine control computer 76 is coupled to an ignition control module 75 and controls the application of the ignition coil current to spark plug 74. Operation of the apparatus of FIG. 6 is in accordance with the logic flow diagram of FIG. 5.

Various modifications and variations will no doubt occur to those skilled in the various arts which this invention pertains. For example, a particular missing tooth sensor may be varied from that disclosed herein. These and all other variations which basically rely on the teachings of this invention are properly considered to come within the scope of the appended claims.

What is claimed:

1. A method of starting an internal combustion engine including the steps of:
using only one engine position sensor;
injecting fuel before true engine position is determined;
determining engine rotational position; and
applying an ignition pulse to the cylinder and firing the ignition coil after fuel has been injected into the cylinder and after engine position has been determined.

2. A method as recited in claim 1 wherein the step of injecting fuel for the cylinder includes the steps of:
determining the engine is turning; and
determining the engine has a rotational rate below a predetermined parameter.

3. A method as recited in claim 2 further comprising the step of monitoring how far the engine has turned since the start of crank so that fuel injection can be synchronized to a desired engine operating position when true engine position is found.

4. A method as recited in claim 3 wherein the firing of the ignition coil occurs upon determining actual engine position.

5. A method of controlling engine fueling and spark including the steps of:
determining if the crankshaft position sensor signal is valid;
determining if the engine rotational speed is below a predetermined value;
starting fueling of the engine; and
continuing the above steps until engine has turned two revolutions or engine position has been determined.

6. A method as recited in claim 5 further comprising:
determining the engine position; and
scheduling an ignition spark and a fuel signal synchronous to engine position.

7. A method as recited in claim 6 further comprising the step of looking for a missing tooth crankshaft position sensor signal to find engine position if engine RPM is above a predetermined limit.

8. A method as recited in claim 7 further comprising the step of looking for a missing tooth crankshaft position sensor signal to find actual engine position if the engine has turned two revolutions since engine cranking began.

9. A method of starting an internal combustion engine including the steps of:
using only one engine position sensor;
determining the engine is turning;
determining the engine has a rotational rate below a predetermined parameter;
monitoring how far the engine has turned since the start of crank so that fuel injection can be synchronized to a desired engine operating position when true engine position is found;
injecting fuel before true engine position is determined;
determining engine rotational position; and
applying an ignition pulse to the cylinder and firing the ignition coil after fuel has been injected into the cylinder and after engine position has been determined.

10. A method of controlling engine fueling and spark including the steps of:
determining if the crankshaft position sensor signal is valid;
determining if the engine rotational speed is below a predetermined value;
starting fueling of the engine;
continuing the above steps until engine has turned two revolutions or engine position has been determined;
determining the engine position;
scheduling an ignition spark and a fuel signal synchronous to engine position; and
looking for a missing tooth crankshaft position sensor signal to find engine position if engine RPM is above a predetermined limit and if engine cranking began.

11. An apparatus for starting an internal combustion including:
a single engine position sensor;
a fuel injector means for injecting fuel for a cylinder before true engine position is determined;
spark plug means for applying an ignition pulse to an air/fuel mixture in the cylinder;
means for determining if the engine is turning;
means for determining the rotational rate of an engine;
means for comparing the rotational rate to a predetermined parameter;
ignition module means for controlling the application of ignition coil current to said spark plug;
electronic engine computer means coupled to said ignition module and said spark plug for;
computer means for injecting fuel into a cylinder before true engine position is determined and firing the ignition coil after the fuel has been injected into the cylinder and true engine position has been determined.

12. An apparatus as recited in claim 11 wherein said computer means determines if the engine position has been determined, if the engine has turned more than two revolutions since the position has been determined and whether a missing tooth in the crankshaft position sensor has been located.

* * * * *